United States Patent [19]

Zur

[11] 4,114,399

[45] Sep. 19, 1978

[54] EARRING FOR PIERCED EAR

[75] Inventor: Walter J. Zur, Blairmore, Canada

[73] Assignee: The Raymond Lee Organization, Inc., New York, N.Y. ; a part interest

[21] Appl. No.: 789,143

[22] Filed: Apr. 20, 1977

[51] Int. Cl.[2] ..... A44C 7/00

[52] U.S. Cl. ..... 63/12; 24/241 S

[58] Field of Search ..... 63/12, 13; 24/241 S, 24/241 SP

[56] References Cited

U.S. PATENT DOCUMENTS

| | | | |
|---|---|---|---|
| 208,968 | 10/1878 | Dolloff | 63/12 |
| 241,462 | 5/1881 | Washburn | 63/12 |
| 360,423 | 4/1887 | Edge | 63/12 |
| 790,965 | 5/1905 | Lieberfreund | 63/12 |

*Primary Examiner*—F. Barry Shay

*Attorney, Agent, or Firm*—Daniel Jay Tick

[57] ABSTRACT

An earring has first and second semiannular parts pivotally affixed to each other at a corresponding end of each whereby when closed the parts form an annular member. A first arm extends inwardly from the opposite end of the first part at approximately 60° therewith and has a pin extending therefrom perpendicularly thereto toward the second part. A notch is formed in the pin in the area of the free end thereof. A second arm extends inwardly from the opposite end of the second part at approximately 60° therewith and has a bore therein for accommodating the pin whereby when the pin is passed into a pierced ear lobe and into the bore of the second arm, the pin is releasably locked to the second arm via the notch of the pin thereby releasably locking the first and second parts together to form an annular member.

1 Claim, 6 Drawing Figures

EARRING FOR PIERCED EAR

BACKGROUND OF THE INVENTION

The present invention relates to an earring for a pierced ear.

Objects of the invention are to provide an earring for a pierced ear, which earring is a simple structure, inexpensive in manufacture, placed in a pierced ear lobe by the wearer thereof with facility, convenience, safety and complete assurance, and remains securely affixed to the ear lobe without difficulty.

BRIEF DESCRIPTION OF THE INVENTION

In order that the invention may be readily carried into effect, it will now be described with reference to the accompanying drawings, wherein.

DETAILED DESCRIPTION OF THE INVENTION

The earring of the invention is for a pierced ear.

Figure 1:
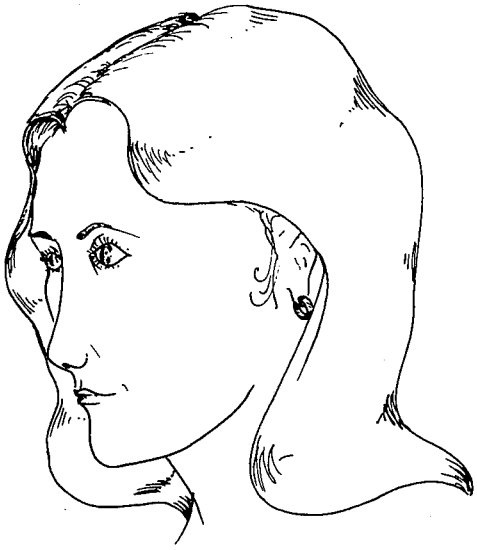
FIG. 1 shows an embodiment of the earring of the invention being worn.
Figure 2:
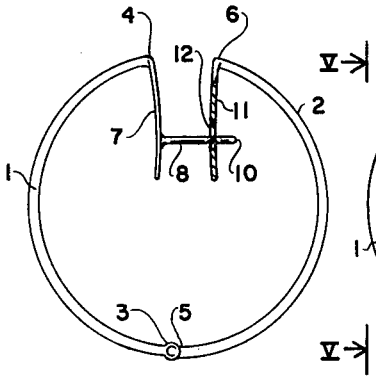
FIG. 2 is a view, on an enlarged scale, partly cut away and partly in section, of an embodiment of the earring of the invention in closed condition.
Figure 3:
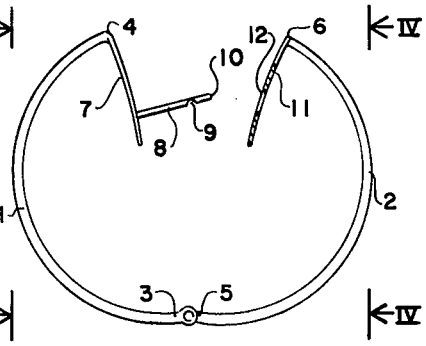
FIG. 3 is a view, on an enlarged scale, partly cut away and partly in section, of an embodiment of the earring of the invention in open condition.
Figure 4:
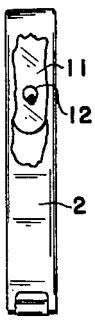
FIG. 4 is a partly cut away view, taken along the lines IV—IV, of FIG. 3.
Figure 5:
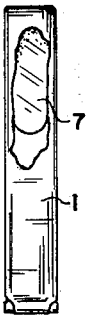
FIG. 5 is a partly cut away view, taken along the lines V—V, of FIG. 3.
Figure 6:
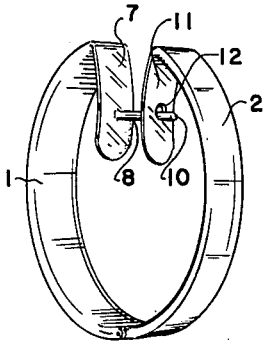
FIG. 6 is a perspective view, on an enlarged scale, of the embodiment of FIGS. 2 to 5.

The earring of the invention comprises first and second substantially semiannular parts 1 and 2 (FIGS. 2 to 6). The part 1 has spaced first and second ends 3 and 4 and the part 2 has spaced first and second ends 5 and 6, as shown in FIGS. 2 and 3. The first end 3 of the part 1 is pivotally affixed to the first end 5 of the part 2 whereby when closed, the parts 1 and 2 form a substantially annular member, as shown in FIGS. 2 and 6. A first arm 7 (FIGS. 2 to 6) extends inwardly from the second end 4 of the first part 1. If a chord about the same length as the arm 7 be drawn from the end 4 of FIG. 3, the arm 7 will be seen to make an angle of approximately 60° with the chord. The first arm 7 has a pin 8 (FIGS. 2, 3 and 6) extending therefrom substantially perpendicularly thereto toward the second part 2. A notch 9 (FIG. 3) is formed in the pin 8 in the area of the free end 10 thereof.

A second arm 11 extends inwardly from the second end 6 of the second part 2 at an angle of approximately 60° with a chord similar to the chord mentioned above (FIGS. 2, 3, 4 and 6). The second arm 11 has a bore 12 therein (FIGS. 2 to 4 and 6) for accommodating the pin 8. Thus, when the pin 8 is passed through a pierced ear lobe and into the bore 12 of the second arm 11, said pin is releasably locked to said second arm via the notch 9 of said pin thereby releasably locking the first and second parts 1 and 2 together to form a substantially annular member.

The first and second arms 7 and 11 are in spaced substantially parallel relation when the earring is closed, see FIG. 2, and somewhat out of parallel when the earring is in open condition, as shown in FIG. 3.

In order to remove the earring, the user need merely press down on the second part 2 at the second end 6 thereof to release the pin 8 from the bore 12 by freeing the notch 9 from the second arm 11.

While the invention has been described by means of a specific example and in a specific embodiment, I do not wish to be limited thereto, for obvious modifications will occur to those skilled in the art without departing from the spirit and the scope of the invention.

I claim:

1. An earring for a pierced ear, said earring comprising first and second substantially semiannular parts having mutually spaced first and second ends, the first end of each being pivotally affixed to the first end of the other whereby when closed said parts form a substantially annular member;

a first arm extending inwardly from the second end of the first part at approximately 60° therewith, said first arm having a pin extending therefrom substantially perpendicularly thereto toward the second part and a notch formed in the pin in the area of the free end thereof; and a second arm extending inwardly from the second end of the second part at approximately 60° therewith, the first and second arms being in spaced substantially parallel relation when the earring is closed, said second arm having a bore therein for accommodating the pin whereby when the pin is passed through a pierced ear lobe and into the bore of the second arm said pin is releasably locked to said second arm via the notch of said pin thereby releasably locking the first and second parts together to form a substantially annular member which may be opened by downward pressure on said second end of said second part.

* * * * *